US010224668B2

(12) United States Patent
Benton et al.

(10) Patent No.: US 10,224,668 B2
(45) Date of Patent: Mar. 5, 2019

(54) ASSEMBLY FOR TERMINATING AN EMF SHIELDED CABLE HARNESS AT AN ELECTRICAL COMPONENT PORT

(71) Applicants: Isodyne, Inc., Wichita, KS (US); Naval Air Warfare Center, Aircraft Division, Patuxent River, MD (US)

(72) Inventors: George E. Benton, Wichita, KS (US); Oliviu Muja, Leonardtown, MD (US)

( * ) Notice: Subject to any disclaimer, the term of this patent is extended or adjusted under 35 U.S.C. 154(b) by 0 days.

(21) Appl. No.: 15/789,791

(22) Filed: Oct. 20, 2017

(65) Prior Publication Data

US 2018/0040973 A1 Feb. 8, 2018

(51) Int. Cl.
*H01R 13/52* (2006.01)
*H01R 9/03* (2006.01)
*H01R 13/6592* (2011.01)

(52) U.S. Cl.
CPC ..... *H01R 13/5205* (2013.01); *H01R 9/037* (2013.01); *H01R 13/6592* (2013.01)

(58) Field of Classification Search
CPC .... H01R 24/38; H01R 13/501; H01R 13/582; H01R 2103/00; H01R 43/26; H01R 9/0527; H01R 43/20; H01R 13/5205; H01R 13/622; H01R 13/6592; H01R 24/30; H01R 25/003; H01R 43/048; H01R 9/037
See application file for complete search history.

(56) References Cited

U.S. PATENT DOCUMENTS 345,767 A 7/1886 Buckley
2,285,850 A 6/1942 Weeks
2,388,537 A 11/1945 Hallstrom et al.
4,140,870 A * 2/1979 Volkers ..... H01R 4/646 174/78
4,280,258 A 7/1981 Kunze
4,622,719 A 11/1986 Rasmussen et al.
(Continued)

FOREIGN PATENT DOCUMENTS

CN 201475224 5/2010
DE 3026582 7/1980
(Continued)

OTHER PUBLICATIONS

Title—Tooling by Design; Author—Ulintz, Peter; Publication—Metal Forming Magazine; Date—Dec. 1, 2011; Relevant section—p. 2, Fig.3.
(Continued)

*Primary Examiner* — Truc T Nguyen
(74) *Attorney, Agent, or Firm* — Kenneth H. Jack; Davis & Jack, L.L.C.

(57) ABSTRACT

An assembly for terminating a sheathed cable harness at an electrical component port, the assembly incorporating a nipple having a hollow bore fitted for receiving the cable harness; a coupling nut mounting the nipple upon the electrical component, the coupling nut being connected to the nipple's proximal end, and being adapted for aligning the hollow bore with the electrical component's port; and a Hunter spring annularly clamping the cable harness's sheath to the nipple, the Hunter spring having an outer end and a plurality of radially outwardly extending teeth, the radially outwardly extending teeth being positioned at the spring's outer end.

6 Claims, 15 Drawing Sheets

(56) References Cited

U.S. PATENT DOCUMENTS

| | | | | |
|---|---|---|---|---|
| 4,875,864 | A * | 10/1989 | Campbell | H01R 4/643 439/100 |
| 4,902,248 | A | 2/1990 | Robertson | |
| 5,028,742 | A | 7/1991 | Redman | |
| 5,542,155 | A | 8/1996 | Kimura et al. | |
| D381,120 | S | 7/1997 | Barker | |
| 5,687,457 | A | 11/1997 | Hama | |
| 5,769,665 | A | 6/1998 | Neely et al. | |
| 5,797,168 | A | 8/1998 | Nagano | |
| 5,895,291 | A * | 4/1999 | Furio | H01R 9/032 439/607.41 |
| 6,256,843 | B1 | 7/2001 | Giovine | |
| 6,398,596 | B1 * | 6/2002 | Malin | H01R 4/42 174/78 |
| 6,438,807 | B1 | 8/2002 | Ptolemy | |
| 6,463,827 | B1 | 10/2002 | Oetiker | |
| 6,591,055 | B1 * | 7/2003 | Eslambolchi | G02B 6/2558 385/136 |
| 6,918,785 | B1 | 7/2005 | Reilly | |
| 7,013,534 | B2 | 3/2006 | Nagano | |
| 7,112,094 | B2 | 9/2006 | Reilly et al. | |
| 7,351,098 | B2 | 4/2008 | Gladd et al. | |
| 7,641,504 | B1 | 1/2010 | Padruzzi | |
| 8,347,495 | B2 | 1/2013 | Biesse et al. | |
| 8,454,383 | B2 | 6/2013 | Paynter et al. | |
| 8,535,085 | B1 | 9/2013 | Reilly | |
| 8,568,158 | B2 | 10/2013 | Mangus | |
| 8,801,604 | B2 | 8/2014 | Hoshino | |
| 9,140,867 | B1 | 9/2015 | Sandate Aguilar et al. | |
| 9,209,571 | B2 | 12/2015 | Myong | |
| 9,219,336 | B2 | 12/2015 | Starke | |
| 2005/0233642 | A1 * | 10/2005 | Gerlich | H01R 4/2408 439/607.41 |
| 2011/0146072 | A1 | 6/2011 | Biesse et al. | |
| 2014/0027965 | A1 | 1/2014 | Holloway et al. | |

FOREIGN PATENT DOCUMENTS

| | | |
|---|---|---|
| GB | 898124 | 6/1962 |
| GB | 2337878 | 12/1999 |
| WO | WO9001225 | 2/1990 |

OTHER PUBLICATIONS

Title—Safety Grating; Author—Unknown; Publication—www.directmetals.com; Date—Sep. 12, 2017; Relevant pp. 10,11.

* cited by examiner

ASSEMBLY FOR TERMINATING AN EMF SHIELDED CABLE HARNESS AT AN ELECTRICAL COMPONENT PORT

FIELD OF THE INVENTION

This invention relates to electrically conductive cable harnesses or bundles which communicate with electronic equipment or components in the nature of radio communication equipment, electronic navigation equipment, radar equipment, computer equipment, computer input and output devices, and the like. More particularly, this invention relates to connector assemblies adapted for securing and anchoring EMF (electromagnetic flux) shielding cable sheaths upon cases, housings, and junction boxes associated upon such components.

BACKGROUND OF THE INVENTION

EMF (electromagnetic flux) shielding cable harness sheaths are commonly composed of metal wire braiding, and such sheaths are known to have their proximal ends attached and anchored at a backshell adapter juncture between the cable harness and an electrical component such as radio communication equipment, electronic navigation equipment, radar equipment, computer equipment and the like. Such braid shield anchoring is known to be achieved by circumferentially wrapping a Hunter spring (also known as Negator or constant force springs) around the proximal end of the sheath and around a backshell adapter connector extension received within the sheath. In such cable assembly, the EMF protected cable harness or cable bundle extends proximally through the bore of the backshell adapter's connector and then extends through an underlying port which opens an electronic component case or housing.

The proximal end of the EMF shielding flexible sheath typically extends annularly about the outer periphery of such backshell adapter connector, and such connector conventionally presents channel forming annular ridges. Where such ridges are provided, the annularly wrapped Hunter spring may perform its sheath clamping function by drawing the sheath radially inwardly into such channel and by binding the sheath against the ridges' edges. In such known EMF shielding sheath and cable terminating assembly, a strong distally directed pulling force typically will not dislodge the sheath from its annularly anchored attachment to the backshell adapter connector.

During performances of tasks of maintaining electrical components of the types described above, or during reconfigurations of cable harness wiring leads extending to and from such components, it is often necessary to detach the EMF shielding sheath from the backshell adapter's connector. Such sheath detachment tasks typically requires that the Hunter spring be unwrapped through application of a counter-circumferentially directed force to the extreme outer end of the Hunter spring. Typically, a technician's application of fingertip pressure to such spring end will either fail to commence the needed spring unwrapping or will undesirably result in a cutting of the technician's fingertip against the spring steel edge of the Hunter spring. Attempts to use a fingernail to unwrap the Hunter spring often undesirably results in fingernail breakage and fingertip cuts. Attempts to use a tool such as a knife or screwdriver blade to drive or pry the end of the Hunter spring in the counter-circumferential direction commonly results in damage to the spring and/or damage to surrounding braid sheathing, threatening EMF leaks.

The instant inventive assembly solves or ameliorates the above described problems associated with the Hunter spring unwrapping and detaching tasks by specially adapting the outer end of the Hunter spring to present pluralities of radially outwardly extending frictional teeth.

BRIEF SUMMARY OF THE INVENTION

A first structural component of the instant inventive assembly for terminating a sheathed cable harness at an electrical component port comprises a rigid backshell adapter connector which is typically composed of stainless steel or a tempered aluminum alloy. In a preferred embodiment, the connector component is cylindrical, having a circular cross-sectional shape, and having a cylindrical hollow bore extending from a proximal attachment end to an opposing distal end. In the preferred embodiment, the connector's hollow bore is sized and fitted for receiving a cable harness or cable bundle. During assembly of the instant invention, such cables may be guided by the connector through a port which opens the case or housing of an electrical component which is served by the cable harness. In accordance with the instant invention, the electrical component may comprise a casing or housing wall of electronic communication equipment, cased electronic navigation equipment, a computer component, or cased radar equipment.

A further structural component of the instant inventive assembly comprises means for mounting the proximal or attachment end of the connector upon the electronic component which is to be served by the cable harness. In a preferred embodiment, such means comprise an externally helically threaded rotatable coupling nut which mounts and aligns the backshell adapter's connector over male threads at the periphery of one of the component's cable ports. Other common fasteners such as fixed helically threaded couplers, pressure fittings, annularly clamped fittings, wholly formed connections, adhesively bonded joints, and welded joints may be suitably substituted for the invention's preferred rotatable coupling nut mounting means.

A further structural component of the instant inventive assembly comprises a Hunter spring which annularly clamps a proximal end of an EMF shielding flexible sheath to the connector's outer surface. In the preferred embodiment, pluralities or series of frictional teeth are formed and presented (preferably via punch formations) the outer end of the Hunter spring. In the preferred embodiment, each tooth series peripherally surrounds an aperture which is punch formed within and through the spring's outer end, each tooth series peripherally surrounding one of such punch formed apertures.

In use of the instant inventive assembly, where the Hunter spring is initially circumferentially wrapped about a backshell adapter's connector and about an annularly overlying EMF shielding sheath, a technician seeking to disassemble the cable harness may easily and conveniently radially inwardly press his or her thumb or fingertip against the teeth, and may frictionally draw the fingertip in the counter-circumferential direction about the connector and the sheath. Such pressing and drawing motion easily splays the outer turn of the spring away from underlying turns, and allows for continued spring unwrapping and detaching. The instant invention's Hunter spring outer turn teeth similarly provide assistance in installation of the spring at its binding and clamping position about the invention's sheath and connector components.

Accordingly, objects of the instant invention include the provision of an assembly for terminating an EMF shielded cable harness at an electrical component port which incorporates structures as described above, and which arranges those structures in relation to each other in manners described above for the achievement of benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
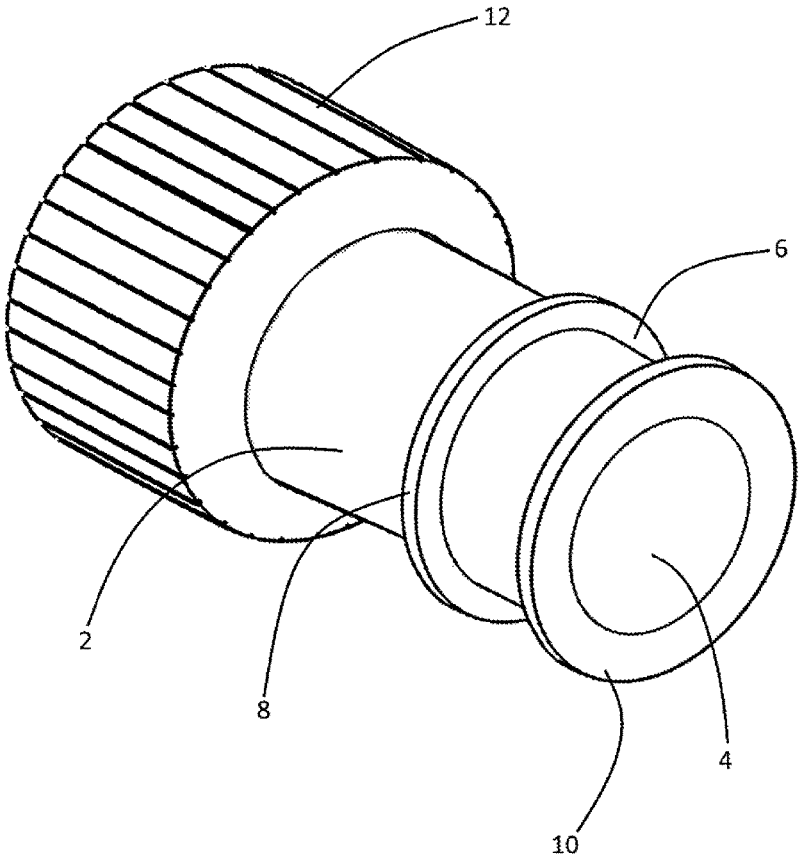
FIG. 1 is a perspective view of a backshell adapter component of the instant inventive assembly for terminating a sheathed cable harness at an electrical component port.
Figure 10:
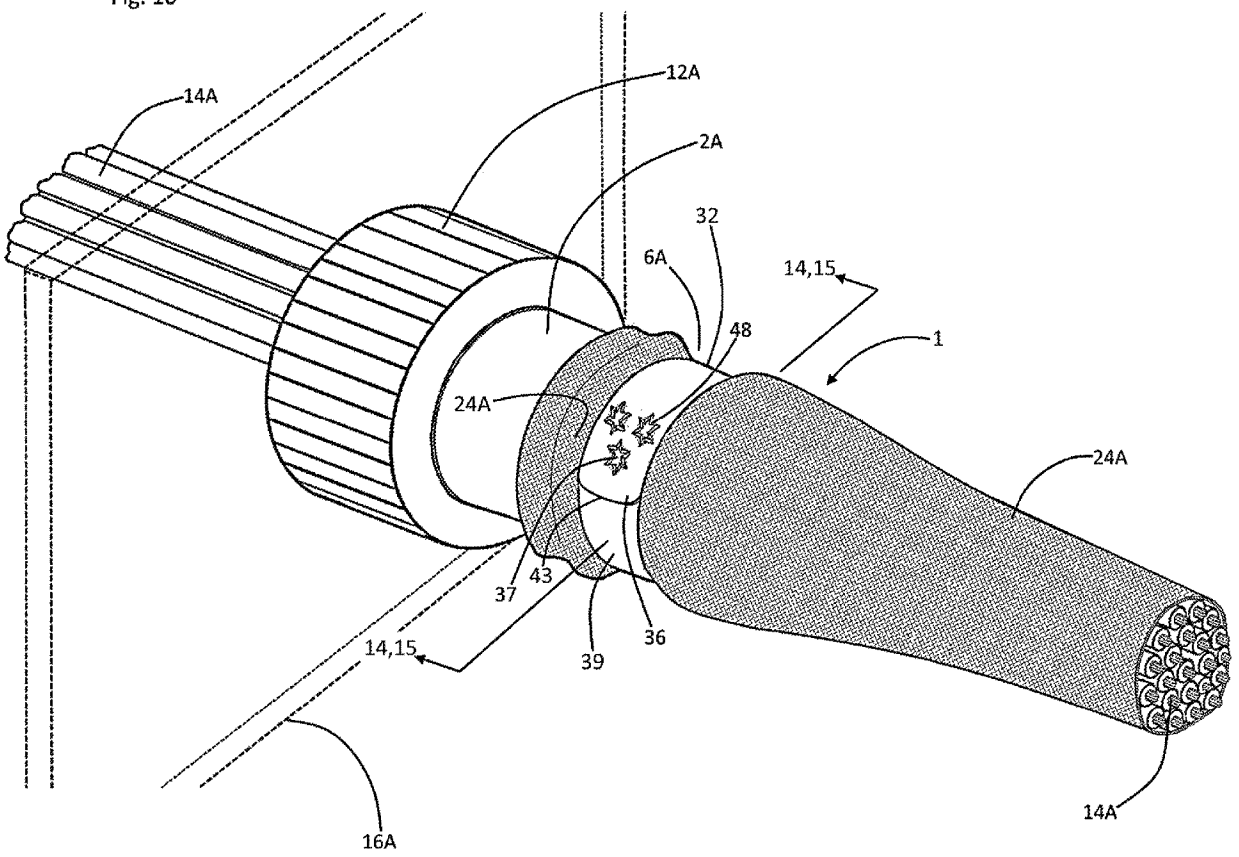
FIG. 10 is a perspective view of the instant inventive assembly.

Referring now to the drawings and in particular to Drawing FIG. 10, a preferred embodiment of the instant inventive assembly for terminating a sheathed cable harness at an electrical component port is referred to generally by Reference Arrow 1. Referring further to FIG. 1, the assembly incorporates a connector 2 having a hollow bore 4 extending distally from a proximal attachment end of the connector 2 to a distal cable harness receiving end, such distal end of bore 4 opening toward the viewer in the view of FIG. 1. The backshell adapter preferably has a pair of annular ridges 8 and 10 which extend radially outwardly from the body of the connector 2 to form an annular clamp receiving channel 6.

Mounting means in the form of a rotatable and internally helically threaded coupling nut 12 are preferably provided at the proximal end of the backshell adapter's connector 2. Such preferred rotatable coupling nut mounting means is intended to be representative of other commonly known fasteners such as non-rotatable helically threaded couplers, pressure fittings, clamp band fittings, adhesively bonded fixtures and joints, and welded or wholly formed fixtures or joints.

Figure 2:
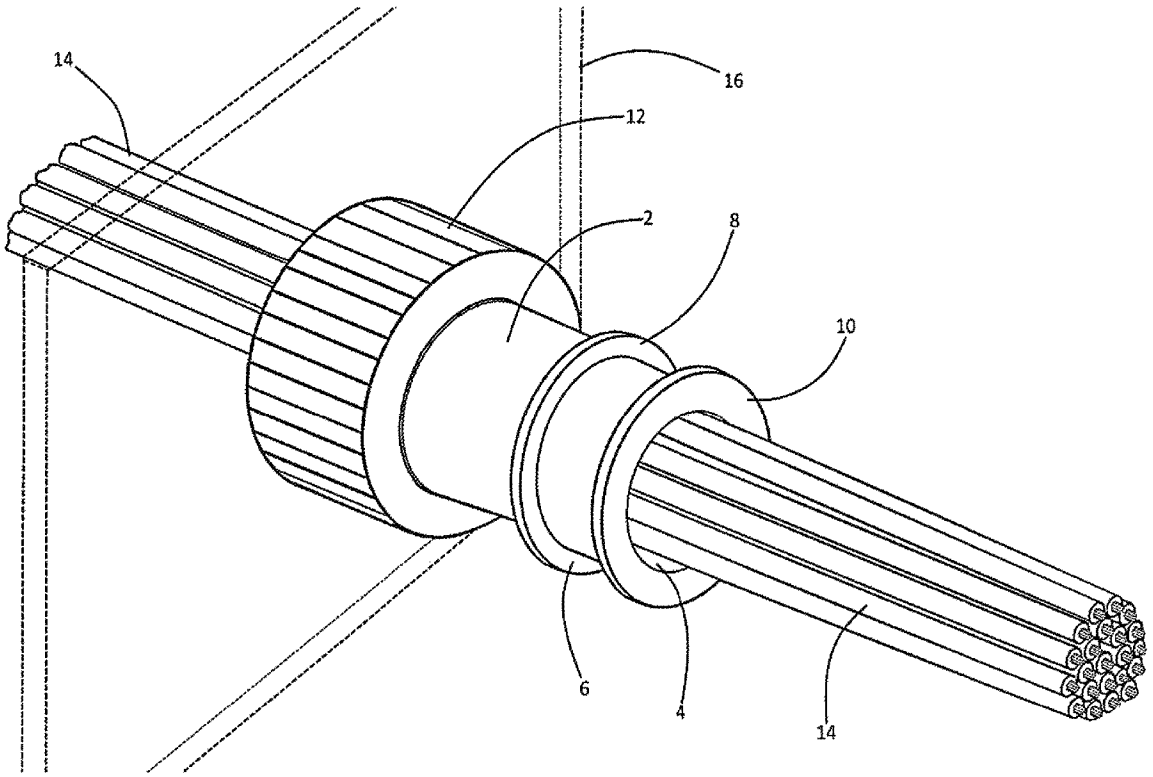
FIG. 2 redepicts the structure of FIG. 1, the view of FIG. 2 further showing a received cable harness including a bundle of electrically conductive wires, and further showing an attachment of the backshell adapter to the case or housing wall of an electronic component.

Referring further FIG. 2, the mounting means 12 preferably securely attach the connector 2 to a casing wall 16 of an electronic component such as radio equipment, electronic navigational equipment, electronic radar equipment, or computer equipment. In the preferred embodiment, such connector attachment provides for wire passage communication between the bore 4 and a cable port (not within views) which opens the electronics case at wall 16. A cable harness including bundle of electrically conductive cables 14 extends through the bore 4 of the connector 2, and thence extends through such component case wall port for electrical communication with components and electronic fixtures housed within the case 16.

Figure 3:
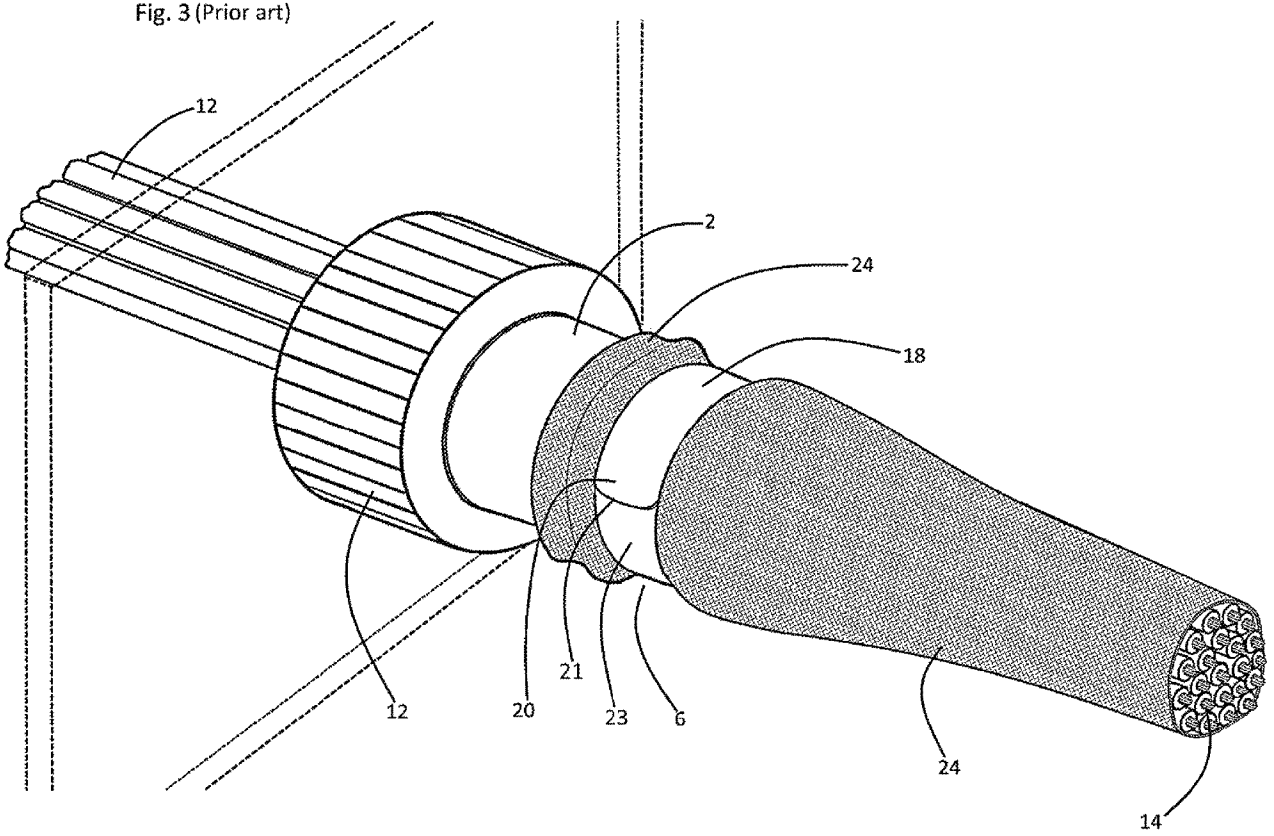
Fig. 3 (Prior art)
FIG. 3 shows a prior art assembly, the view redepicting the structures of FIG. 2 and additionally showing a flexible EMF shielding metal braid sheath extending over the cables and showing installation of an annularly clamping Hunter spring.

Referring further to FIG. 3, a flexible metal braid sheath 24 protectively receives and extends along the cable harness 14, such sheath serving a purpose of preventing ambient electromagnetic flux (EMF) surrounding the cable harness 14 from inducing extraneous micro-electrical currents within the cable harness's conductors.

In order to securely anchor and terminate the proximal end of the EMF shielding sheath 24 at the cable harness's points of entry into connector 2 and into electronics case 16, an annular clamp in the form of a Hunter (or Negator or constant force) spring 18 is circumferentially wrapped about the sheath 24 and about the radially underlying connector 2. Such spring wrapping advantageously draws a circumferential portion of the proximal end of the sheath 24 radially inwardly toward the floor of the connector's annular channel 6. Utilization of such Hunter spring 18 to annularly clamp the sheath 24 upon the connector 2 advantageously resists extreme distally directed pulling forces which may otherwise undesirably detach the sheath 24 from the connector 2.

Figure 4:
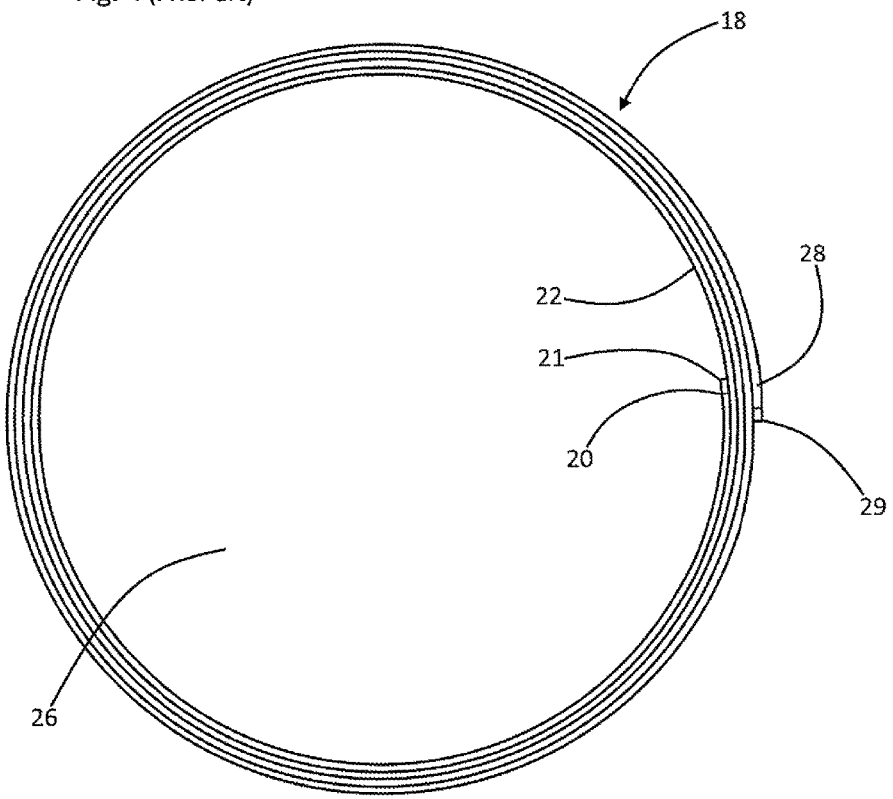
Fig. 4 (Prior art)
FIG. 4 shows a side view of a prior art Hunter spring.

A spirally obverted reconfiguration of the Hunter spring 18 of FIG. 3 is depicted in side view in FIG. 4. In order to install the obverted spring of FIG. 4 in the finally installed circumferentially wrapped configuration of FIG. 3, a technician may grasp the spring's multiple spring turns 22 in his or her left hand, and may attempt to use fingertip pressure or fingernail wedging pressure against spring end 29 to counter-circumferentially raise and splay the temporarily outer spring end 28 away from the underlying turns 22. In doing so, the technician often breaks his or her fingernail and/or receives a fingertip cut from the spring's sharp edge 29. In the event that the technician successfully splays spring end 28, the technician may extend such spring end 28 over the rightward aspect of sheath 24 and nipple 2 at a location overlying annular channel 6. Thereafter, the technician may hold such outer spring end 28 in place within channel 6 while obvertingly wrapping the spring 18 in the counter-clockwise or circumferential direction. Such counter-clockwise wrapping redefines the outer spring end 28 of FIG. 4 as the spring's newly configured inner spring end, and such wrapping redefines FIG. 4's inner spring end 20 as outer spring end 20 of the FIG. 3 configuration. Upon such wrapping installation, the Hunter spring 18, the sheath 24, the nipple 2, and the cable harness 14 newly reside within the spring's central space 26 while the spring securely clamps the sheath 24 in place.

Subsequent to an installation of the Hunter spring 18 within channel 6 in the configuration depicted in FIG. 3, the technician may need to deinstall the sheath 24 for purposes of effecting changes to or reconfigurations of the cable harness 14. In FIG. 3's installed configuration, the Hunter spring 18 annularly nests within channel 6 with EMF shielding metal braid 24 closely bounding and blocking the proximal and distal faces of the spring's spiral turns. Such spring side blocking further complicate and make more difficult the technician's repeated task of unwrapping and deinstalling the spring 18. Fingertip pressure applied by the technician to the outer spring end 20 typically fails to raise or splay such spring end away from underlying ends 22, and any fingernail engagement with the extreme counter-circumferential edge 21 of spring end 20 further threatens undesirable nail breakage and cutting of fingertips. Alternative usages of wedge tools such as a screwdriver blade or a knife blade (not depicted within views) at the juncture of edge 21 the immediately underlying spring turn 23 will often undesirably damage to the spring 18 and/or surrounding braid surfaces of the sheath 24.

Referring to FIGS. 5-9, in order to solve or ameliorate the Hunter spring installation and deinstallation problems and challenges discussed above, the instant invention introduces into a Hunter spring 32 (configured similarly with FIG. 4's spring 18) pluralities of radially outwardly extending frictional teeth 48. In order to form the teeth 48, a fabricator of the instant inventive assembly may temporarily circumferentially splay spring end 36 away from the immediately underlying turn of the spring, and may lay such spring end 36 upon an anvil surface suitably comprising a support table 70 having a semi-rigid and relatively flexible upper surface 72. Thereafter, a punch 55 having a contact surface 57 may be placed over the radially inner surface of spring end 36. Thereafter, the punch 54 may be forcefully driven downwardly against such inner spring surface.

Figure 5:
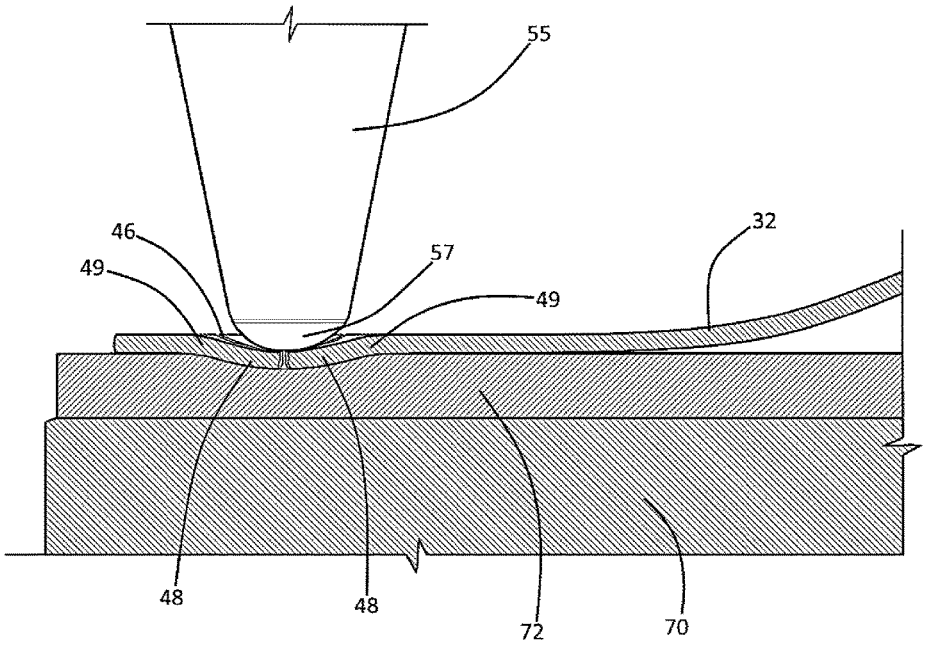
FIG. 5 shows a punch forming adaptation of a Hunter spring of the type depicted in FIG. 4.
Figure 6:
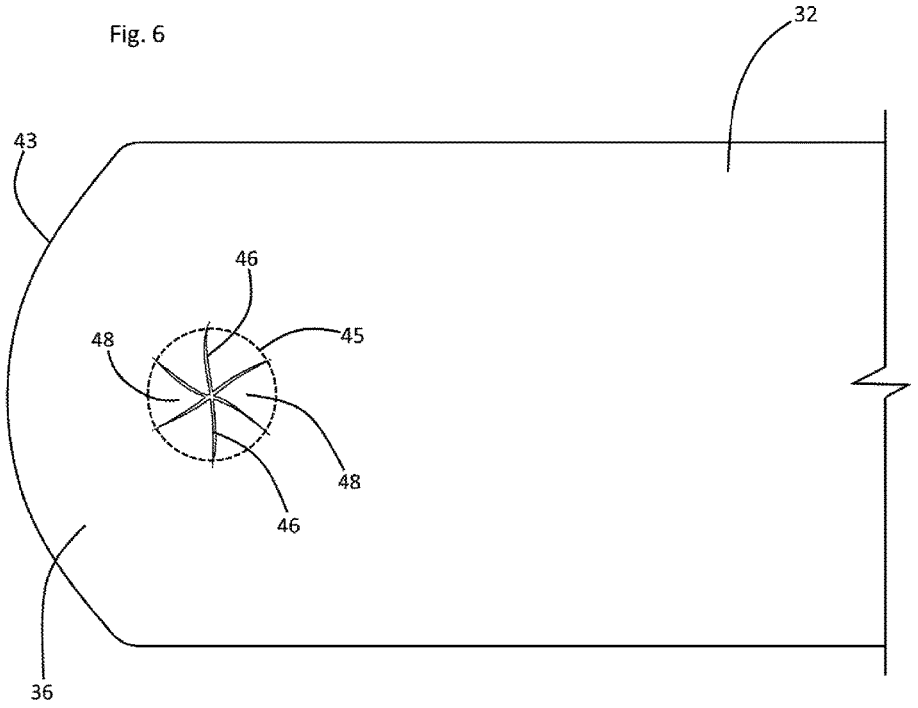
FIG. 6 is a plan view of an outer end of the Hunter spring of FIG. 5.

Referring simultaneously to FIGS. 5 and 6, the downward driving force of punch 55 against spring end 36 initially deflects a disk shaped portion 45 of the spring end 36 downwardly into flexible surface 72. Due to the typical spring steel character of the Hunter spring 32, such downward punch driving force and localized deflection desirably creates a radial array of tensile fractures or cracks 46, such fractures 46 advantageously peripherally defining series of frictional teeth 48.

Figure 7:
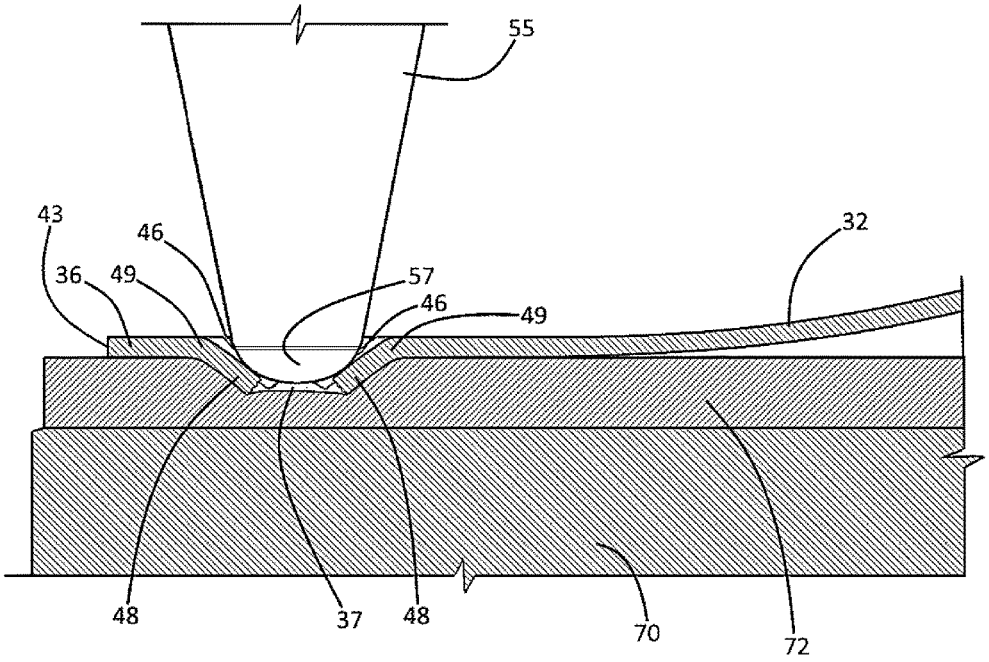
FIG. 7 redepicts the structure of FIG. 5, the view of FIG. 7 showing a metal forming continuation of the punch driving step depicted in FIG. 5.
Figure 8:
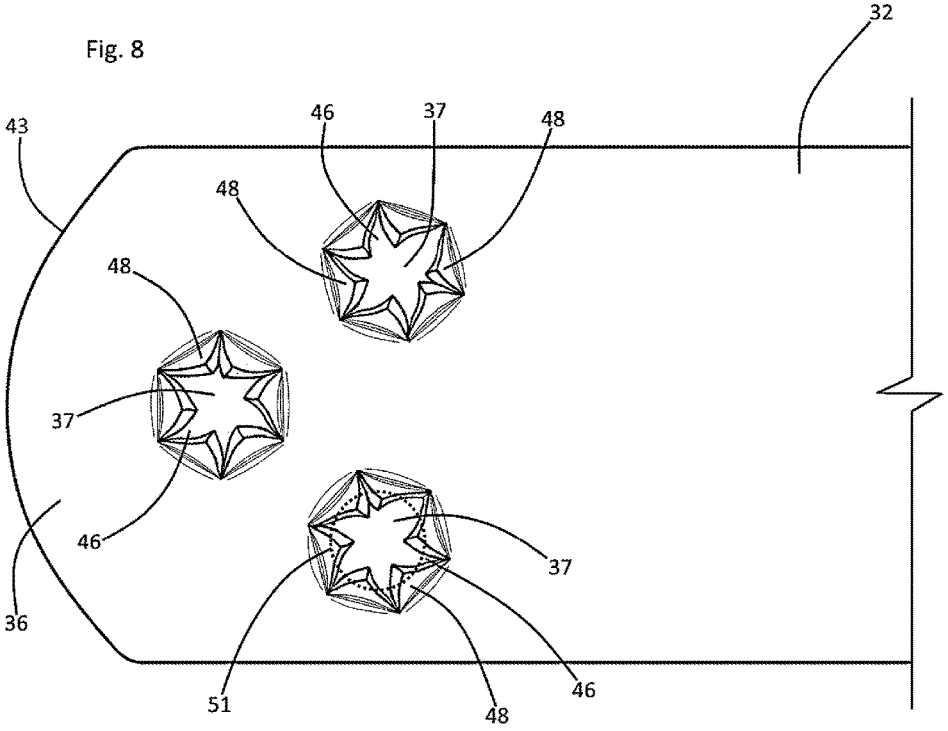
FIG. 8 redepicts the structure of FIG. 6, the view of FIG. 8 showing a plurality of punch formed frictional teeth.

Referring to FIGS. 7-10, the instant invention's tooth forming downward driving punch action preferably continues until peripheral series of bends 49 are formed at the teeth's bases. As shown in FIGS. 8 and 10, a triangular arrangement of the punch formed tooth series is preferably formed, with each series of teeth being peripherally arrayed about a punch formed aperture 37. In the preferred embodiment, the radially inner base of each tooth 48 is positioned at the periphery 51 of one of such apertures 47, and said each tooth's base end is effectively fixedly attached to and wholly formed with Hunter spring 32 by one of the punch formed spring steel bends 49. Each of the radially arrayed tensile fractures 46 advantageously resides between a peripherally adjacent pair of the teeth 48, said each fracture forming and defining adjacent side edges of such adjacent teeth.

Figure 9:
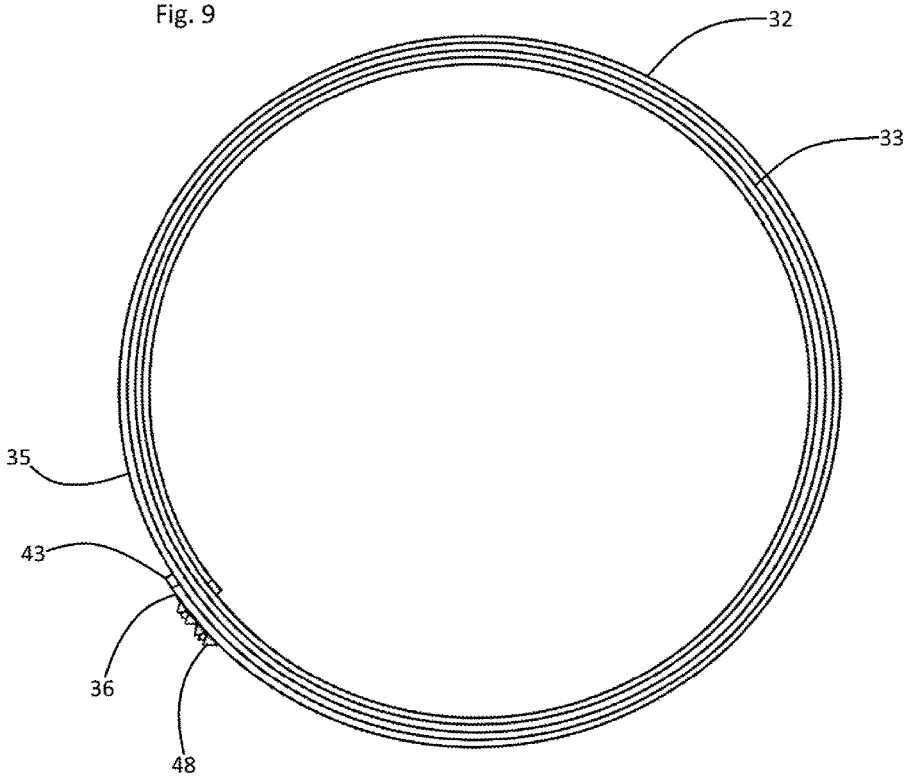
FIG. 9 is a side view of a pre-installation configuration of the instant invention's Hunter spring component.
Figure 11:
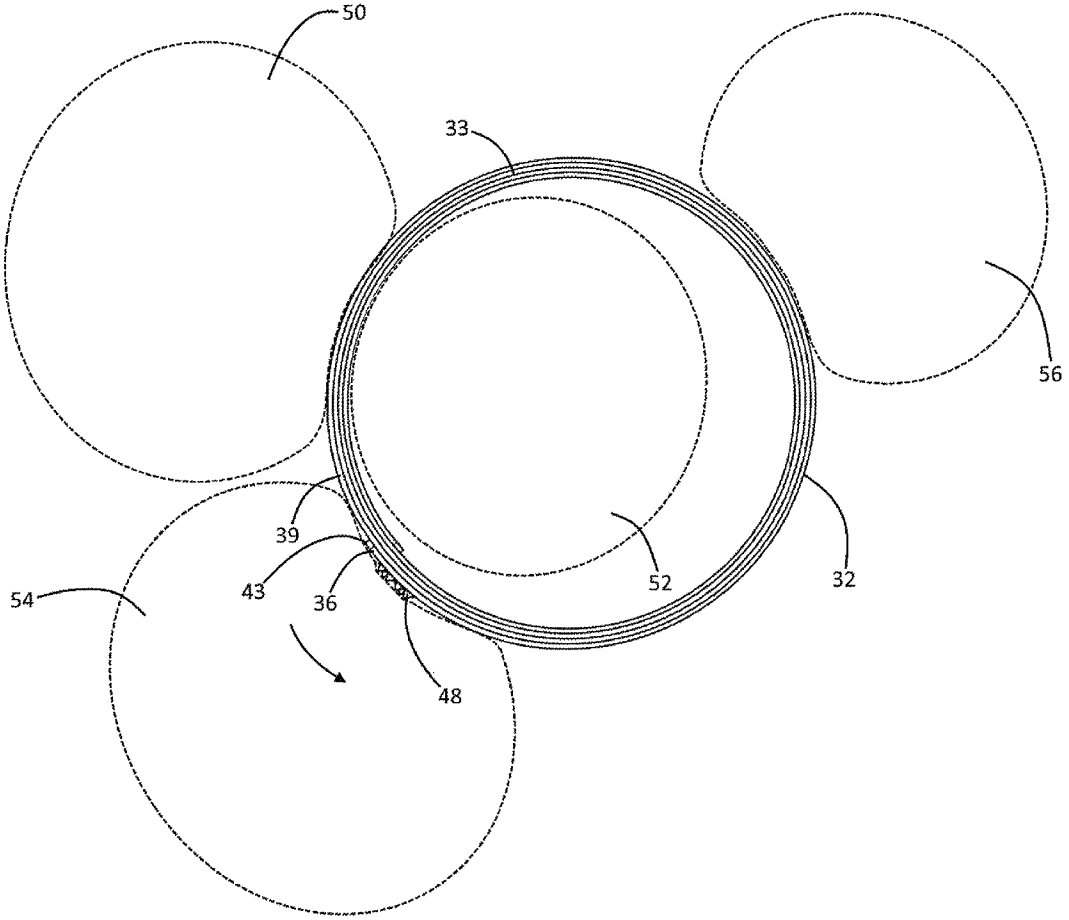
FIG. 11 redepicts the structure of FIG. 9, the view further showing in dashed lines applications of spring unwrapping fingertip pressure.

Following fabrications of the preferably triangular arrangement of teeth 48 in their arrayed series about apertures 37 as indicated in FIGS. 7 and 8, the spring 32 may be initially positioned as indicated in FIG. 9. Thereafter, a technician performing a task of installing the spring 32 within the instant inventive assembly may, referring further to FIG. 11, grasp the turns 33 of spring 32 between the thumb 50 and index finger 52 of his or her left hand. Thereafter, the technician may further grasp the spring 32 between the thumb 54 and index finger 56 of his or her right hand, such right handed grasp placing the technician's thumb 54 directly against teeth 48. Thereafter, the technician may move thumb 54 in the counter-clockwise or circumferential direction indicated by the arrow drawn upon FIG. 11. Upon such fingertip grasping and motion, friction between teeth 48 and thumb 54 advantageously splays spring end 36 away from the immediately underlying spring turn 39.

According to the function of the invention, such frictionally assisted splaying is advantageously achieved without any contact of thumb 54 with the spring's sharp extreme end or edge 43.

Figure 12:
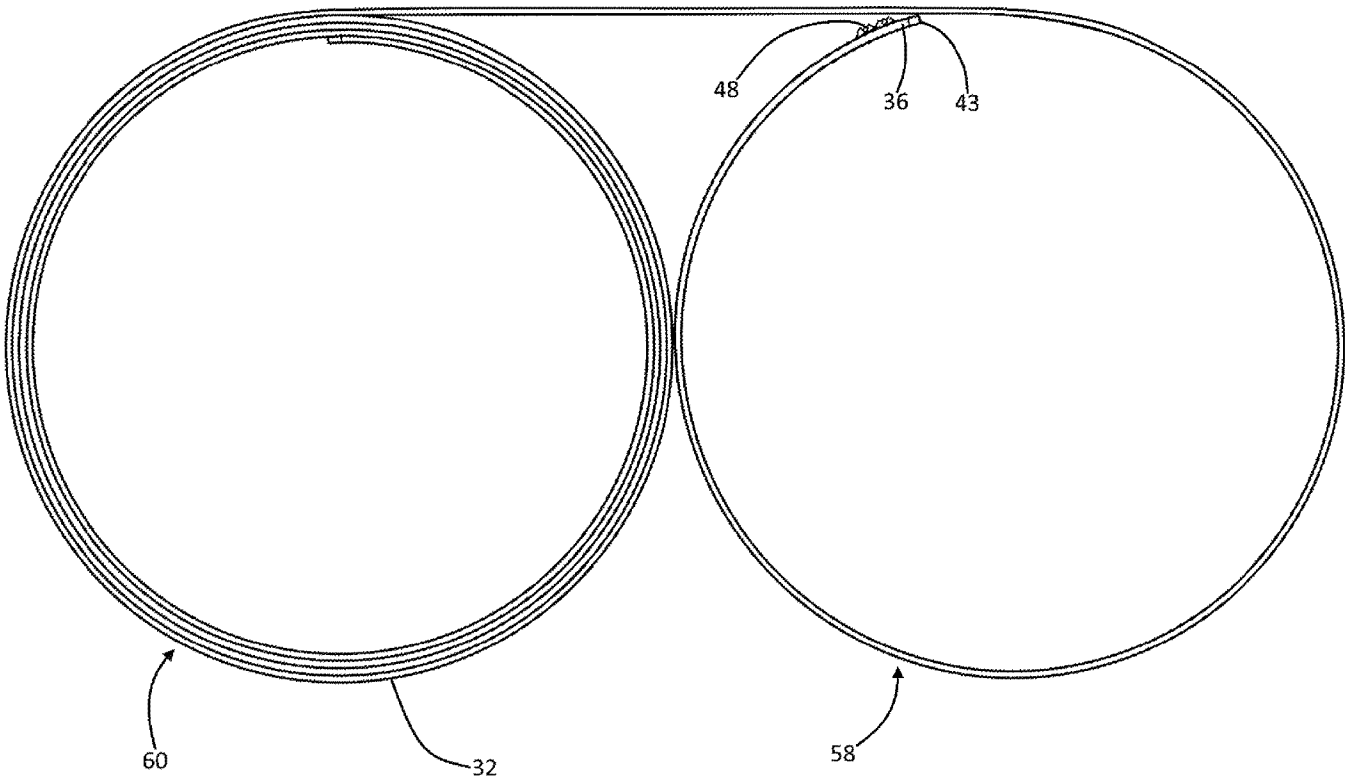
FIG. 12 redepicts the structure of FIG. 11 in a single turn unwrapping configuration.
Figure 13:
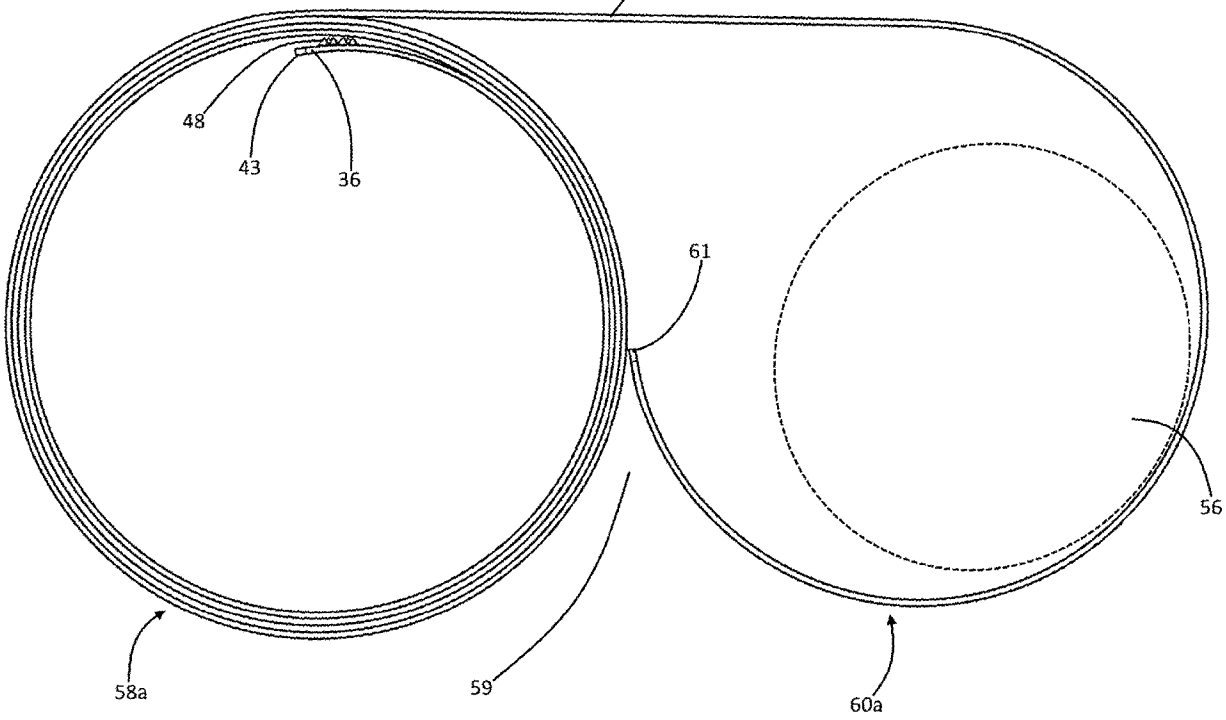
FIG. 13 presents a 180° rotated and partially spirally obverted view of the structure of FIG. 12.

Following such finger pressure induced splaying of spring end 36, the technician may, referring further to FIG. 12, rightwardly displace the outer turn of the spring 32 to form a rightward loop 58 and a leftward loop 60. Thereafter, the technician may turn the spring 180° and may leftwardly scroll the loops 58 and 60 to form reconfigured loops **58*a* and 60*a*, as indicated in FIG. 13. In the FIG. 13 configuration, a sheath/ connector receiving "V" or valley 59*a*** is advantageously formed.

Figure 14:
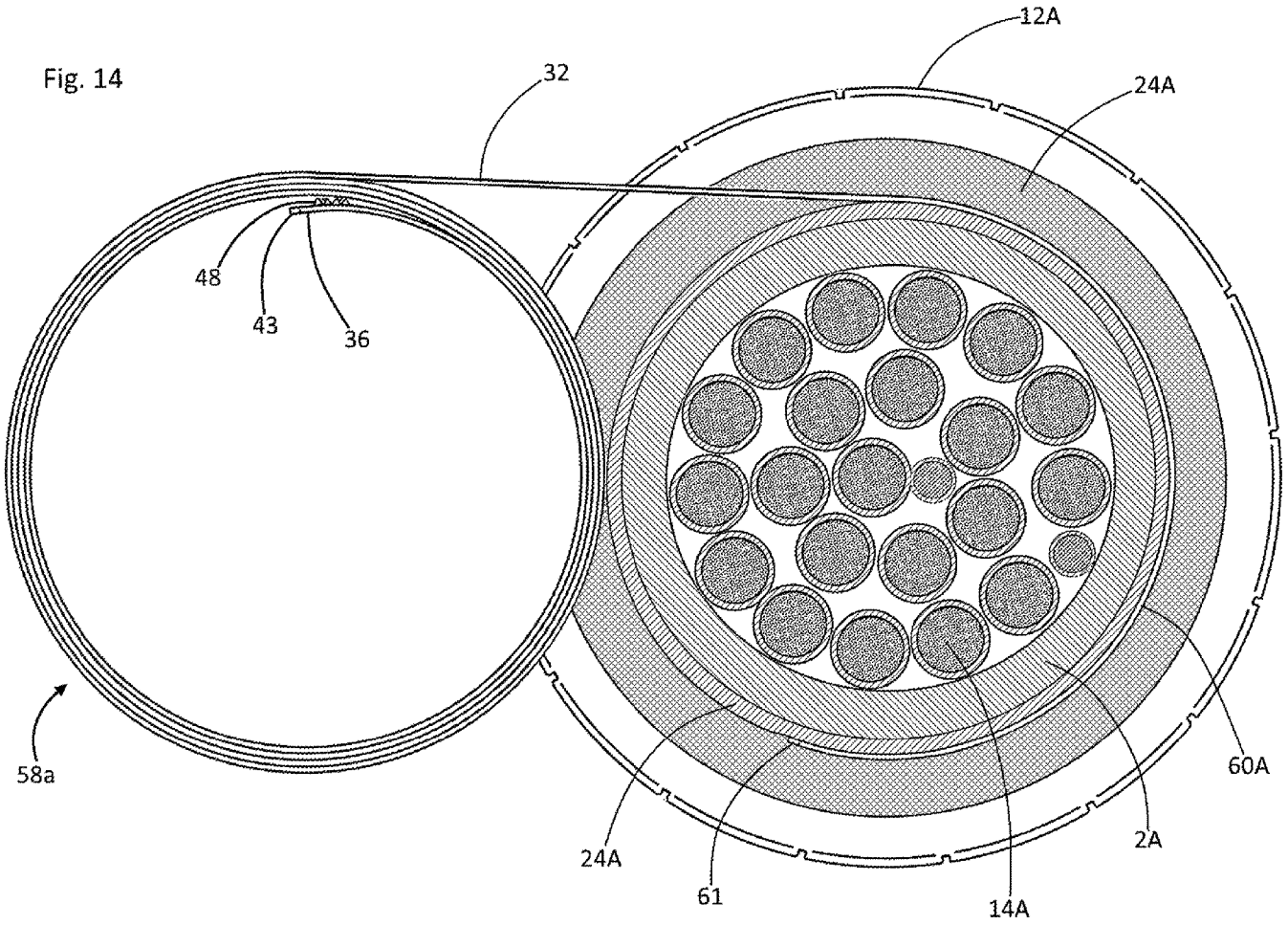
FIG. 14 redepicts the structure of FIG. 13, the view additionally showing sectional view structures as indicated in FIG. 10.

Thereafter, the technician may position the valley 59 over channel 6A and may drive the spring 32 downwardly against sheath 24A and nipple 2A, such driving action causing the sheath and nipple to act as mandrel which splays loops **58*a* and 60*a* away from each other. Simultaneously, with such mandrel splaying effect, the technician may use his or her index finger 56 within loop space 63 to draw the extreme inner edge 61 of the spring 32 toward the rightward aspect of channel 6A. Such mandrel splaying and drawing actions advantageously allow the spring 32 to assume a pre-installation configuration as indicated in FIG. 14. Thereafter, the technician may wrap loop 58*a* in the counter-clockwise/ circumferential direction about loop 60*a*, and about its underlying sheath 29A and nipple 2A structures, to assume the finally installed configuration indicated in FIGS. 10 and 15. Subsequent clockwise fingertip pressure against teeth 48 advantageously de-installs the spring without any risk of cutting of fingertips upon edge 43**.

Figure 15:
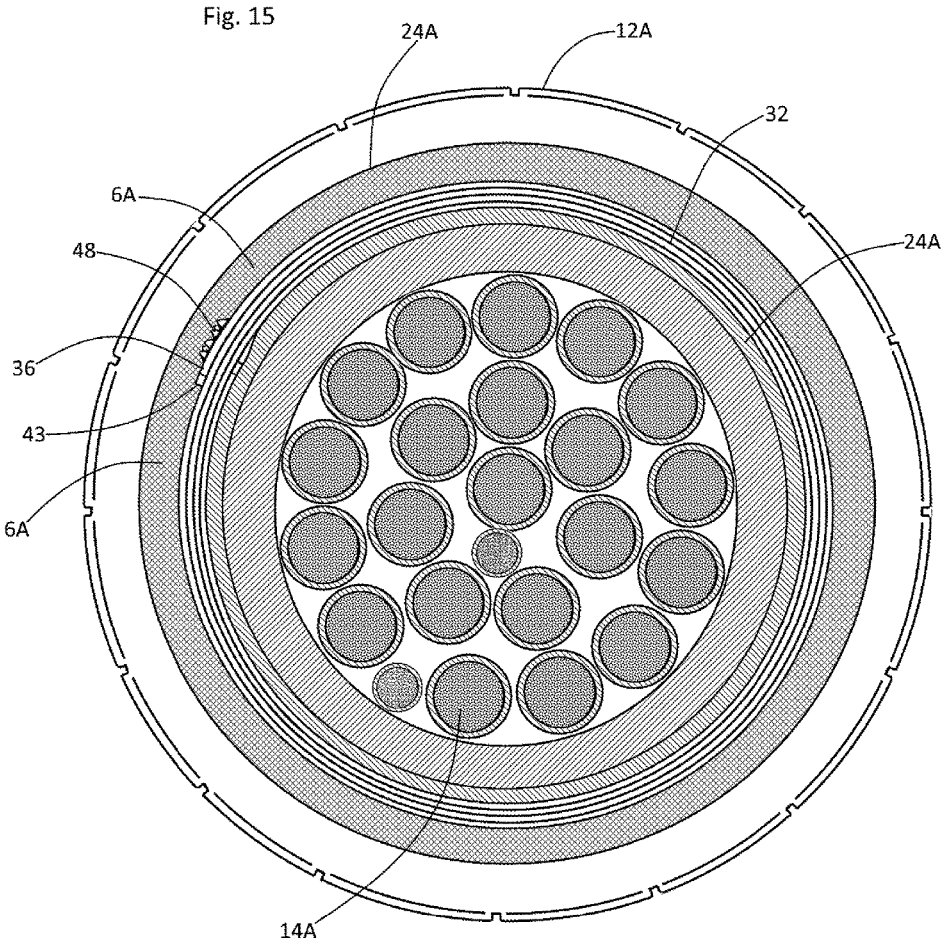
FIG. 15 is a sectional view as indicated in FIG. 10.

Referring in particular to FIG. 15, the instant invention's punch formed teeth 48 advantageously allow spring end 36 to concentrically extend in the circumferential direction a short distance beyond the teeth 48. Such concentric extension advantageously prevents and avoids any radially outward extension of the extreme outer end or edge 43 of the spring 32 into the channel annulus 6A. Additional protective sheathings often radially overly and extend into such annulus 6A, and the instant invention's concentric circumferential extension of the spring end 36 to the spring's extreme circumferential end or face 43 advantageously avoids cutting impingements of such end 43 against such overlying protective sheathing.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. An assembly for terminating a sheathed cable harness at an electrical component port, said assembly comprising:

(a) a connector having a proximal end, a distal end, a radially outer surface, and a hollow bore extending between said ends, the hollow bore being positioned radially inwardly from said radially outer surface and being fitted for receiving the cable harness;

(b) means for mounting the connector upon the electrical component, said means being connected operatively to the connector's proximal end, and said means being adapted for communicating the connector's hollow bore with the electrical component's port; and (c) a Negator spring annularly clamping the cable harness's sheath to the connector, said spring having an outer end, said outer end having a plurality of teeth, said teeth extending away from the radially inwardly positioned hollow bore.

2. The assembly of claim 1 wherein the Negator spring has an outer end and an outer edge, and wherein said spring's outer end extends concentrically from the teeth to the outer edge.

3. assembly of claim 2 further comprising a plurality of spring end apertures wherein each aperture among the plurality of spring end apertures has a periphery, wherein each tooth among the plurality of teeth has a base and a frictional contact end, and wherein said each tooth's base end is positioned at one of the apertures' peripheries.

4. The assembly of claim 3 further comprising a plurality of tooth extending bends, each such bend wholly forming the base end of one of the teeth with the Negator spring.

5. The assembly of claim 4 further comprising a plurality of tensile fracture seams, each tensile fracture seam residing between an adjacent pair of the teeth.

6. The assembly of claim 5 wherein the spring end apertures are arranged in a triangular array.

* * * * *